United States Patent [19]

Dortzbach

[11] 4,386,571

[45] Jun. 7, 1983

[54] ADJUSTABLE SPARK ARRESTER FOR FIREPLACE FLUE

[76] Inventor: Richard A. Dortzbach, 12801 Marsh Creek Rd., Clayton, Calif. 94517

[21] Appl. No.: 346,276

[22] Filed: Feb. 5, 1982

[51] Int. Cl.[3] ..... F23J 15/00

[52] U.S. Cl. ..... 110/119; 98/67; 98/83

[58] Field of Search ..... 110/119, 125, 145; 98/67

[56] References Cited

U.S. PATENT DOCUMENTS 198,343 12/1877 Bryan ..... 110/119

841,660 1/1907 Barnes ..... 98/67

2,582,905 1/1952 Harmon ..... 98/83

4,325,291 4/1982 Paynton et al. ..... 98/67

FOREIGN PATENT DOCUMENTS 241883 10/1925 United Kingdom ..... 110/119

*Primary Examiner*—Edward G. Favors

*Attorney, Agent, or Firm*—Robert G. Slick

[57] ABSTRACT

An adjustable spark arrester for a chimney flue is provided wherein the arrester hood is held by adjustable means permitting the arrester to be installed without the use of tools.

4 Claims, 2 Drawing Figures

ADJUSTABLE SPARK ARRESTER FOR FIREPLACE FLUE

SUMMARY OF THE INVENTION

Sparks from chimneys are serious affairs and many possible spark arresters have been proposed.

The problem with such spark arresters as have been used in the past is that they are ordinarily complicated affairs, most of which are designed to fit a specific size of flue. The installation of such spark arresters is ordinarily a job for a professional.

Since the arresters in the past have been expensive and difficult to install, the use of such spark arresters has not been widespread.

In accordance with the present invention, an adjustable spark arrester is provided for a chimney flue which eliminates hot sparks and ashes from leaving the chimney top until cool. The unit of the present invention is relatively light and inexpensive. However, its biggest virtue is that it can be installed without tools by the average homeowner, coupled with the fact that it is adjustable so that one size can fit all popular size flue liners.

Various other features and advantages of the invention will be brought out in the balance of the specification.

DESCRIPTION OF THE PREFERRED EMBODIMENTS

Figure 1:
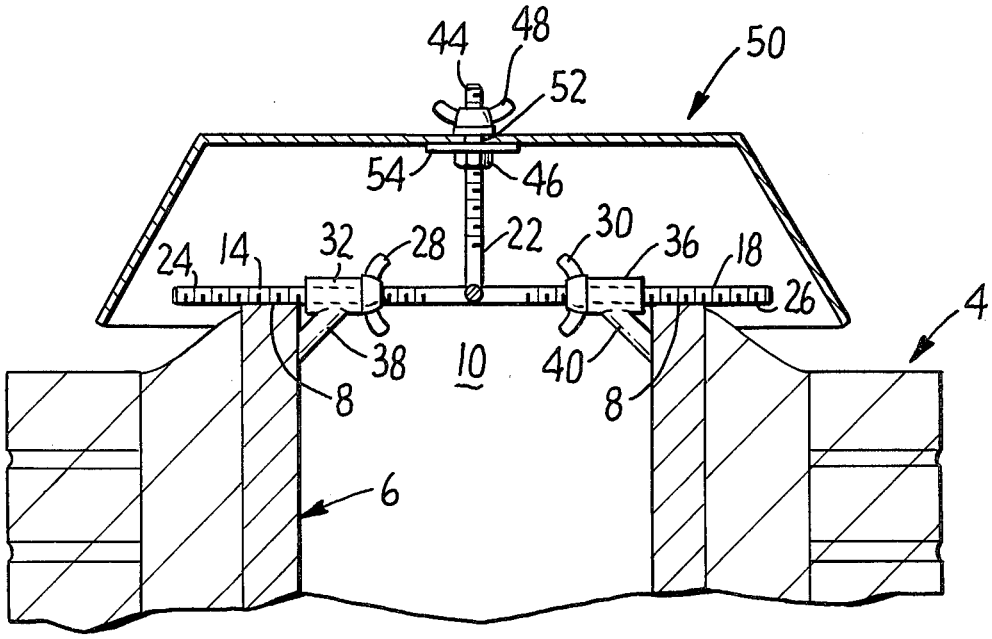
FIG. 1 is a side view, partly in section, of a chimney flue showing an arrester embodying the present invention in position.

Referring now to the drawings by reference characters, there is shown a chimney generally designated 4 having the usual liner 6. The liner 6 has a horizontal flat surface 8 leaving the conventional central opening 10.

In a preferred embodiment of the invention, the bracket for holding the spark arrester hood consists of four horizontal arms, namely 12, 14, 16 and 18. All of the four arms have been given separate numbers but normally the four arms would be fabricated of two pieces of metal so that 12 and 16 would form one rod and 14 and 18 would form a second rod, held together at the center 20 by welding or other suitable means. At the center 20 is also fastened a vertical rod 22, again by welding or other suitable means. In this embodiment of the invention, the arms 14 and 18 are threaded as at 24 and 26 and are provided with wing nuts, respectively, 28 and 30. On each of the two threaded rods is mounted a slider 32 and 34, each of which has a downwardly extending prong 38 and 40. The ends of the prongs are flattened as at 42, the angle being such that the end of each of the prongs is substantially vertical when the device is installed.

The vertical arm 22 is threaded as at 44 and is provided with a plain nut 46 and a wing nut 48. The spark arrester hood generally designated 50 is of conventional design and may be made of screen wire, expanded metal or the like. It has a central opening 52 through which the vertical arm 22 can pass.

In use, the hood 50 would first be removed from the bracket and the nuts 28 and 30 moved towards the center so that the prongs 38 and 40 are separated by less than the diameter of the flue. Now one merely rests the arms 12, 14, 16 and 18 on the top 8 of the flue. The vertical arm 22 is now roughly centered at the center of the flue and the nuts 28 and 30 turned, forcing the sliders 32 and 36 out so that the prongs 38 and 40 firmly engage the inner wall of the liner 6. Now the nut 46 is adjusted to the height at which it is desired to have the top of the hood and, if desired, a washer 54 placed on top of the nut. Hood 50 is now put into place and the nut 48 screwed down to hold the hood firmly in place. Thus, the device of the present invention can be installed by an unskilled amateur without the use of tools, greatly increasing the availability and utility of the device.

Figure 2:
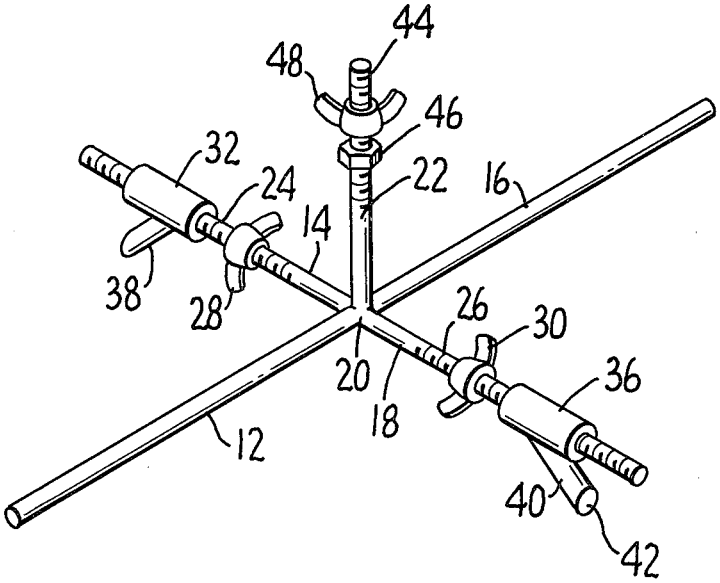
FIG. 2 is a perspective view of the bracket which holds the arrester hood in position and which forms the crux of the present invention.

Although a preferred embodiment of the invention has been shown, many variations can be made in the exact structure illustrated without departing from the spirit of this invention. For instance, for a round flue three arms rather than four might be employed. Further, although it is not ordinarily necessary, all four arms in the embodiment shown in FIG. 2 might be threaded and provided with sliders. If the spark arrester were designed to be used with only a single size of flue, it would only be necessary to employ a single adjustable slider and the opposing prong might be fixed upon a horizontal arm. Although wing nuts have been shown, since this is preferred obviating the need for tools, ordinary nuts could be substituted in which case the device could be installed utilizing a simple wrench.

I claim:

1. An adjustable spark arrester for chimney flues comprising in combination:

a. at least three horizontal arms radiating from a central point, said arms being secured together at said point, b. a plurality of downwardly directed prongs slidably mounted on said arms, c. a vertical member extending upwardly from said arms adapted to hold a spark arrester hood, d. adjustment nut means adapted to hold said prongs in an extended position whereby:

e. said arms can rest on the top of a flue and said prongs can engage the inner surface of the flue holding the spark arrester in place.

2. The spark arrester of claim 1 having four arms extending from said central point and having said prongs on two opposed arms.

3. The spark arrester of claim 2 wherein the two arms holding said prongs are threaded and have wing nuts on said arms, said wing nuts serving as the adjustment means to hold said prongs in an extended position.

4. The spark arrester of claim 3 wherein said vertical member is threaded and provided with a pair of nuts to hold said hood therebetween.

* * * * *